US008647247B2

(12) United States Patent
Pazdernik et al.

(10) Patent No.: US 8,647,247 B2
(45) Date of Patent: Feb. 11, 2014

(54) CONTINUOUS MOTION CASE FORMER

(75) Inventors: Irvan L. Pazdernik, Alexandria, MN (US); Jeffery L. Lenarz, Garfield, MN (US); Randy K. Thoen, Alexandria, MN (US); Paul Anderson, Alexandria, MN (US); Mark Larson, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 224 days.

(21) Appl. No.: 13/107,377

(22) Filed: May 13, 2011

(65) Prior Publication Data

US 2012/0122640 A1 May 17, 2012

Related U.S. Application Data

(60) Provisional application No. 61/334,367, filed on May 13, 2010.

(51) Int. Cl.
*B31B 3/00* (2006.01)

(52) U.S. Cl.
USPC ..... 493/52; 493/175

(58) Field of Classification Search
USPC ..... 53/52, 163, 175, 176, 181, 182, 183, 53/250, 305, 306
See application file for complete search history.

(56) References Cited

U.S. PATENT DOCUMENTS

| | | | | |
|---|---|---|---|---|
| 567,658 | A | | 9/1896 | Rose |
| 1,422,580 | A | | 7/1922 | Kondolf |
| 1,894,209 | A | | 1/1933 | Wikstrom |
| 2,503,431 | A | | 4/1950 | Bender et al. |
| 3,602,108 | A | | 8/1971 | Vuilleumier et al. |
| 3,747,394 | A | | 7/1973 | Cunningham |
| 4,027,522 | A | | 6/1977 | Clavin |
| 4,133,253 | A | * | 1/1979 | Butt ..... 493/91 |
| 4,242,949 | A | | 1/1981 | Auckenthaler |
| 4,308,020 | A | * | 12/1981 | Langen ..... 493/175 |
| 4,308,023 | A | * | 12/1981 | Bidegain ..... 493/295 |
| 4,352,285 | A | | 10/1982 | LaRue et al. |
| 4,932,930 | A | | 6/1990 | Coalier et al. |
| 4,945,007 | A | | 7/1990 | Coalier et al. |
| 5,147,271 | A | | 9/1992 | Bacques et al. |
| 5,327,765 | A | | 7/1994 | Weykamp et al. |
| 5,381,948 | A | | 1/1995 | Coalier et al. |
| 5,624,368 | A | | 4/1997 | Cromwell |
| 5,656,006 | A | * | 8/1997 | East et al. ..... 493/171 |
| 5,704,540 | A | | 1/1998 | Coalier et al. |
| 5,878,946 | A | | 3/1999 | Frerot et al. |
| 6,106,450 | A | * | 8/2000 | Brittain ..... 493/171 |
| 6,257,411 | B1 | | 7/2001 | Bacques et al. |
| 6,394,742 | B1 | | 5/2002 | Buscema |

(Continued)

*Primary Examiner* — Hemant M Desai
(74) *Attorney, Agent, or Firm* — Nawrocki, Rooney & Sivertson, P.A.

(57) ABSTRACT

Among other things, a case forming system is provided. The system includes a conveyance apparatus for conveying case precursors along a conveyance path and a case set-up apparatus characterized by a case forming member. Upstream case precursors are conveyed along the conveyance path for operation thereupon by the case forming member. A case forming mandrel of a mandrel assembly is movably mounted in relation to the conveyance apparatus for continuous motion with respect thereto. The continuous motion is delimited by travel of the case forming mandrel between an upstream locus and a downstream locus of the conveyance path, and reversible extension of the case forming mandrel towards case precursors during travel between the upstream locus and the downstream locus of the conveyance path.

20 Claims, 18 Drawing Sheets

(56) References Cited

U.S. PATENT DOCUMENTS

| | | | | |
|---|---|---|---|---|
| 6,412,765 | B1 | 7/2002 | Blakeley | |
| 7,509,789 | B2 | 3/2009 | Scholtes et al. | |
| 7,682,300 | B2 * | 3/2010 | Graham et al. | 493/84 |
| 8,133,163 | B2 * | 3/2012 | Strong et al. | 493/175 |
| 2005/0137072 | A1 | 6/2005 | Jackson | |
| 2008/0032878 | A1 * | 2/2008 | Kisch | 493/174 |
| 2011/0319241 | A1 * | 12/2011 | Mate' et al. | 493/52 |

* cited by examiner

CONTINUOUS MOTION CASE FORMER

This is a United States national patent application filed pursuant to 35 USC §111(a) claiming priority under 35 USC §120 of/to U.S. Pat. Appl. Ser. No. 61/334,367 having a filing date of May 13, 2010 and entitled CONTINUOUS MOTION CASE FORMER, the disclosure of which is hereby incorporated by reference in its entirety.

TECHNICAL FIELD

The present invention generally relates to automated case or carton manipulations, and/or operations upon a case or carton precursor in furtherance of case formation, more particularly, to continuous motion automated case set-up and intermittent motion case folding/case erection, more particularly still, to any of systems, assemblies, apparatus, mechanisms, methods, etc. attendant to such continuous or intermittent motion automated case manipulations and/or operations upon a case precursor in furtherance of case set-up and formation.

BACKGROUND OF THE INVENTION

The automated erection of a case or carton from a source of case or carton precursors such as, without limitation, blanks, adapted blanks, knocked-down-flat sleeves, etc. is well known, and is, for all practical purposes, a preliminary or requisite step with regard to subsequent automated carton related actions. Multifunction lines and/or stations are common place, and may be fairly characterized by the steps of case erection, filling/loading, and closure.

Initial case forming operations are generally a function of the state, nature or character of the precursor, e.g., whether the precursor is a blank or adapted blank (i.e., a sheet or planar article), or a sleeve, e.g., a knocked-down-flat sleeve, with mandrels commonly utilized to aid case forming operations in either scenario. Generally speaking, mandrels facilitate case sidewall formation or erection by offering a case sidewall contact or engagement surface. Moreover, and as generally is realized with manipulations of work pieces upon/about a mandrel, means are commonly provided to facilitate separation of the cooperating elements without altering the work completed during the period of engagement of the cooperating elements, for instance the inclusion of retractable mandrel members or the like.

In connection to case precursors comprising case blanks or the like, a portion of the case blank, e.g., adjacent sidewall segments are caused to be received between two opposing operative elements in furtherance of case formation. In a first well known approach, a case blank is positioned over a well or die, with a mandrel (e.g., a plunger) forcing the blank into the die in furtherance of sidewall, and commonly base formation (see e.g., U.S. Pat. No. 1,422,580 (Kondolf); U.S. Pat. No. 1,894,209 (Wikstrom); U.S. Pat. No. 3,602,108 (Vuilleumier); U.S. Pat. No. 7,509,789 (Scholtes et al.); and, Pub. No. 2005/0137072 (Jackson). In an alternate well known approach, a case precursor is presented for manipulation (e.g., wrapping) about a mandrel (see e.g., U.S. Pat. No. 4,242,949 (Auckenthaler); U.S. Pat. No. 5,147,271 (Bacques et al.); and, U.S. Pat. No. 5,656,006 (East et al).

It is to be noted that mandrel utilization is not exclusive to case blank operations. Manipulations of knocked-down-flat sleeves or the like are known to benefit from such devices. Flattened case sleeves, originating from a supply or magazine of such sleeves, are initially manipulated (i.e., "opened") from their initial collapsed condition so as to at least define an open sleeve, and thereafter may be stabilized in furtherance of additional forming operations by an expansible mandrel or the like receivable within the preliminarily formed case.

For example, U.S. Pat. No. 6,106,450 (Brittain) describes a ram head assembly characterized by outwardly extendable plows for receipt within an open end of an initially erected case to positively form oblique cornered wall panels along score lines provide for such manipulation (FIG. 3). Moreover, U.S. Pat. No. 5,624,368 (Cromwell) provides a set up fixture characterized by a rotatably mounted center post equipped with a pair of opposing wing plates which function to "square up" the box in relation to a fixture base in advance of manipulation of end flaps (FIGS. 8-10).

Among other things, it is essential that the formed cases be dependably of the design configuration specified and required, and without variation from one case batch to another case batch, and from case to case within a batch. In addition to at least meeting design specifications and thereby functional performance (e.g., securely, safely and reliably carrying goods from at least point A to point B), or in furtherance thereof, the equipment of the automated case erectors and/or packers must precisely handle, and manipulate the case precursors; initially seal/partially close initially formed cases from the precursors; and, pack and finally seal/close cases so formed. Variation in these regards from case to case may well render such cases unsatisfactory for use because such mechanized operations are dependent for proper operation in numerous respects on receiving cases only of the designated design configuration and dimensions, as well as those characterized by what oftentimes are tight processing tolerances.

A further and present reality is that the design of cases, cartons, containers, etc., and as a result, the design of mechanized processes and equipment for the formation of same, have become increasingly more sophisticated and complex. While there remains a steady demand for garden variety or general container or packaging solutions, user demands for greater particularity with regard to the production of cases, cartons, containers, etc. of more complex designs better suited to particular uses have increased. A not insubstantial challenge has been the concomitant progress/advancement of case former apparatuses of the case former operations, and the vision to expand the variety, nature, and/or character of goods to be case packed which in turn necessitate improvements in case formation and/or erection.

While arguable incremental improvements have been made with regard to next generation cartons, more particularly, processes and equipment for forming same, it remains advantageous to form cases from case precursors in sufficient volume, at sufficient speed and with sufficient precision to make emerging container solutions practical for wide spread commercial adoption, and offer more efficiently produced general container solutions in the marketplace. Further still, it is desirable to provide, in the form of one or more of any of systems, assemblies, apparatuses, mechanisms, methods, etc. a continuous motion automated case former, more particularly, to advance the art via provisions for greater sensitivity, dexterity and speed, as well as provisions for reliable continuous motion operations, with regard to the formation of cases related to known and emerging container solutions.

SUMMARY OF THE INVENTION

A case forming system, assemblies thereof, and attendant case forming processes are provided. Provisions are generally made to, among other things, eliminate, or at least minimize the duration and/or frequency of start stop operations associated with heretofore known case forming processes/apparatuses. Moreover, precise swiftly executed highly repeatable operations are sought for such process/system/apparatus.

An advantageous case forming system includes a conveyance apparatus for conveying case precursors along a conveyance path, and a case set-up apparatus characterized by a case forming member. Upstream case precursors are conveyed along the conveyance path for operation thereupon by the case forming member. A case forming mandrel of a mandrel assembly is movably mounted in relation to the conveyance apparatus for continuos motion with respect thereto. The continuous motion is delimited by travel of the case forming mandrel between an upstream locus and a downstream locus of the conveyance path, and reversible extension of the case forming mandrel towards case precursors during travel between the upstream locus and the downstream locus of the conveyance path.

The case forming mandrel is advantageously characterized by expansible elements upon which case precursors are receivable and acted upon by the case forming member of the case set-up apparatus. More particularly, the case precursors are so acted upon during extension of the case forming mandrel at the downstream locus of the conveyance path.

An advantageous case forming apparatus is likewise provided and includes a mandrel head assembly and a mandrel head assembly support. The mandrel head assembly is movably supported for reversible linear motion in relation to the mandrel head assembly support so as to define a mandrel head assembly travel path. The mandrel head assembly is characterized by spaced apart case forming mandrels, and a base upon which each spaced apart case forming mandrel of the spaced apart case forming mandrels is movably supported for reversible linear motion so as to define a case forming mandrel travel path. Travel of the case forming mandrels through the case forming mandrel travel path is concurrent or simultaneous with travel of the mandrel head assembly through the mandrel head assembly travel path so as to thereby delimit a portion of a continuous motion travel path for the spaced apart case forming mandrels.

Lastly, advantageous case forming methods are provided. Steps of one method include indexingly metering case precursors along a conveyance path in furtherance of executing forming related operations upon the case precursors. A first work station is provided within a portion of the conveyance path for executing select forming related operations upon a case precursor of the indexingly metered case precursors, and a continuous motion apparatus is provided adjacent the conveyance path for travel therealong. An element of the continuous motion apparatus is selectively actuatable in furtherance of executing the select forming related operations at the first work station. Forming related operations upon the case precursors at the first work station are then executed subsequent to actuation of the selectively actuatable element of the continuous motion apparatus.

Optionally, the subject method may include provisions for providing an apparatus adjacent the conveyance path. The apparatus may be stationary/static or movably mounted in relation to the conveyance apparatus for continuous or intermittent motion therealong. Elements of the apparatus are selectively actuatable in furtherance of executing an operation of the select forming related operations at the first work station.

DETAILED DESCRIPTION OF THE INVENTION

Advantageous, non-limiting systems, apparatus, devices, mechanisms, assemblies, subassemblies, structures, etc. are presented throughout the figures of the subject disclosure, namely FIGS. 1-18. By way of overview, a continuous motion case forming system is generally depicted in the alternate views, elevation and plan, of FIGS. 1 & 2, and thereafter, a variety of views of the continuous motion case former of the system of FIG. 1 are presented (FIGS. 3-7).

Figure 3:
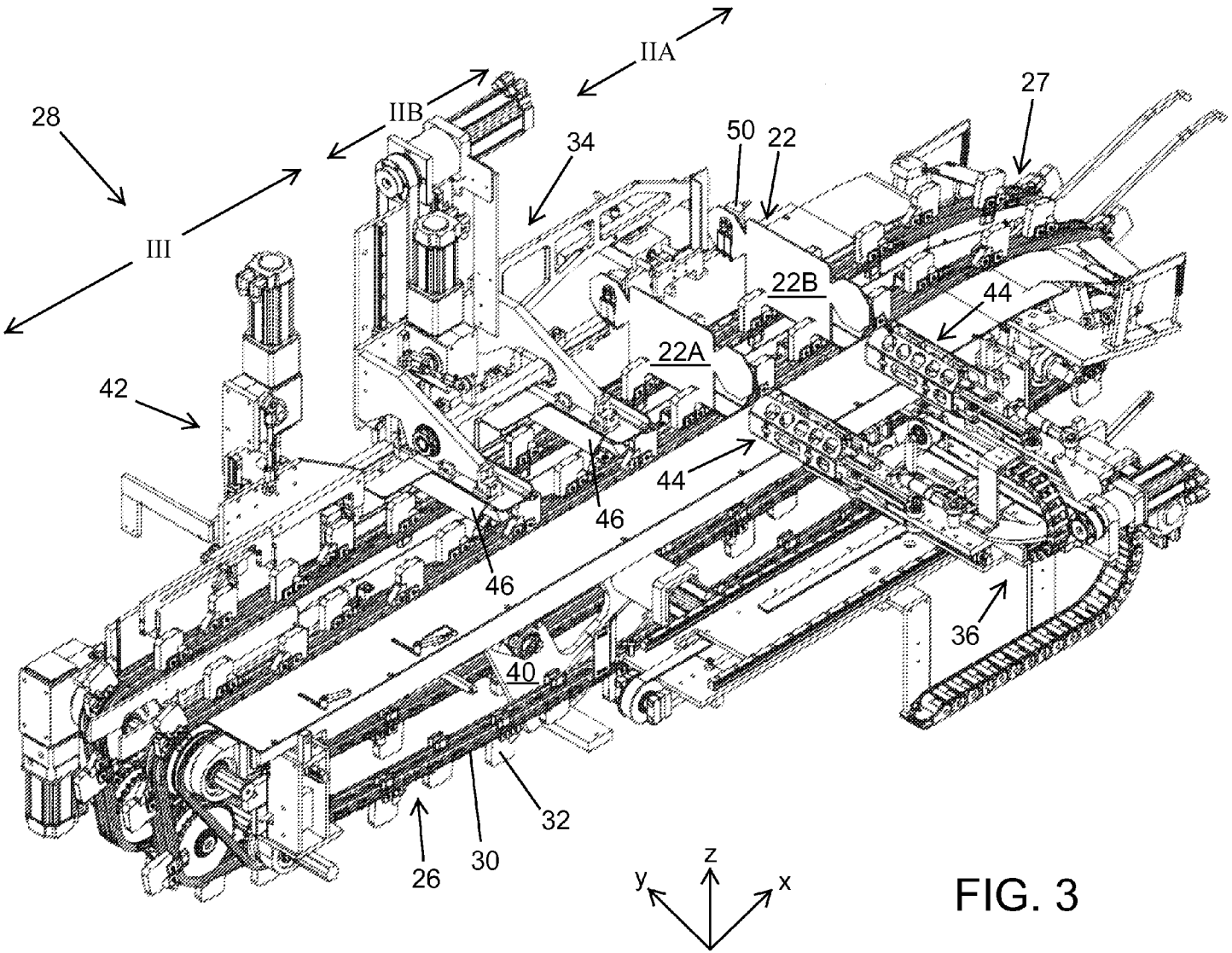
FIG. 3 depicts, in perspective, slightly from above as viewed from a "downstream" locus, portions of the system of FIG. 1, more particularly, portions downstream of case precursor feed station I, namely, an advantageous, non-limiting continuous motion case former, more particularly, the initial case forming station II, and the subsequent case forming station III.
Figure 4:
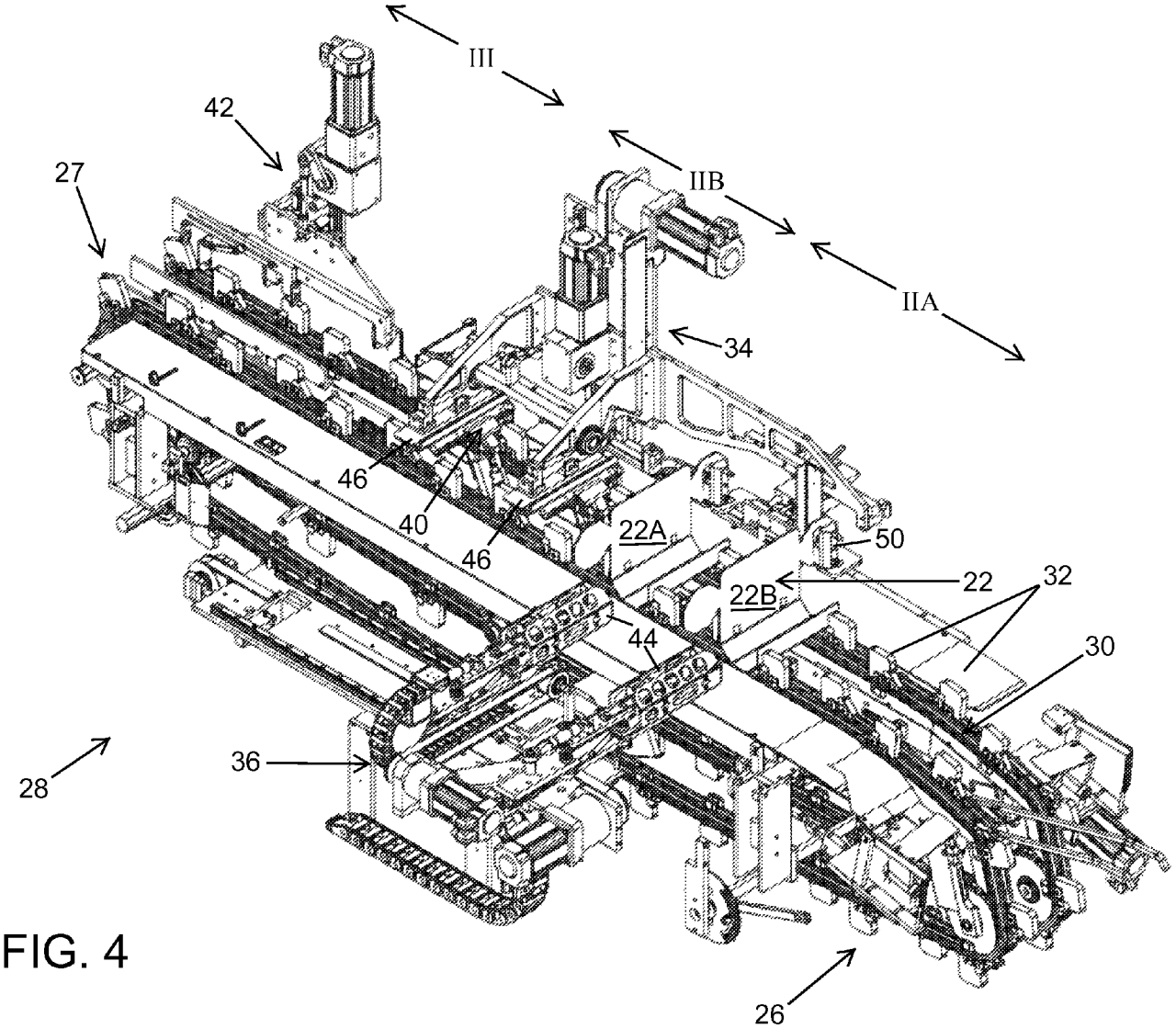
FIG. 4 depicts, as viewed from an "upstream" locus, the former stations or portions of FIG. 3.
Figure 5:
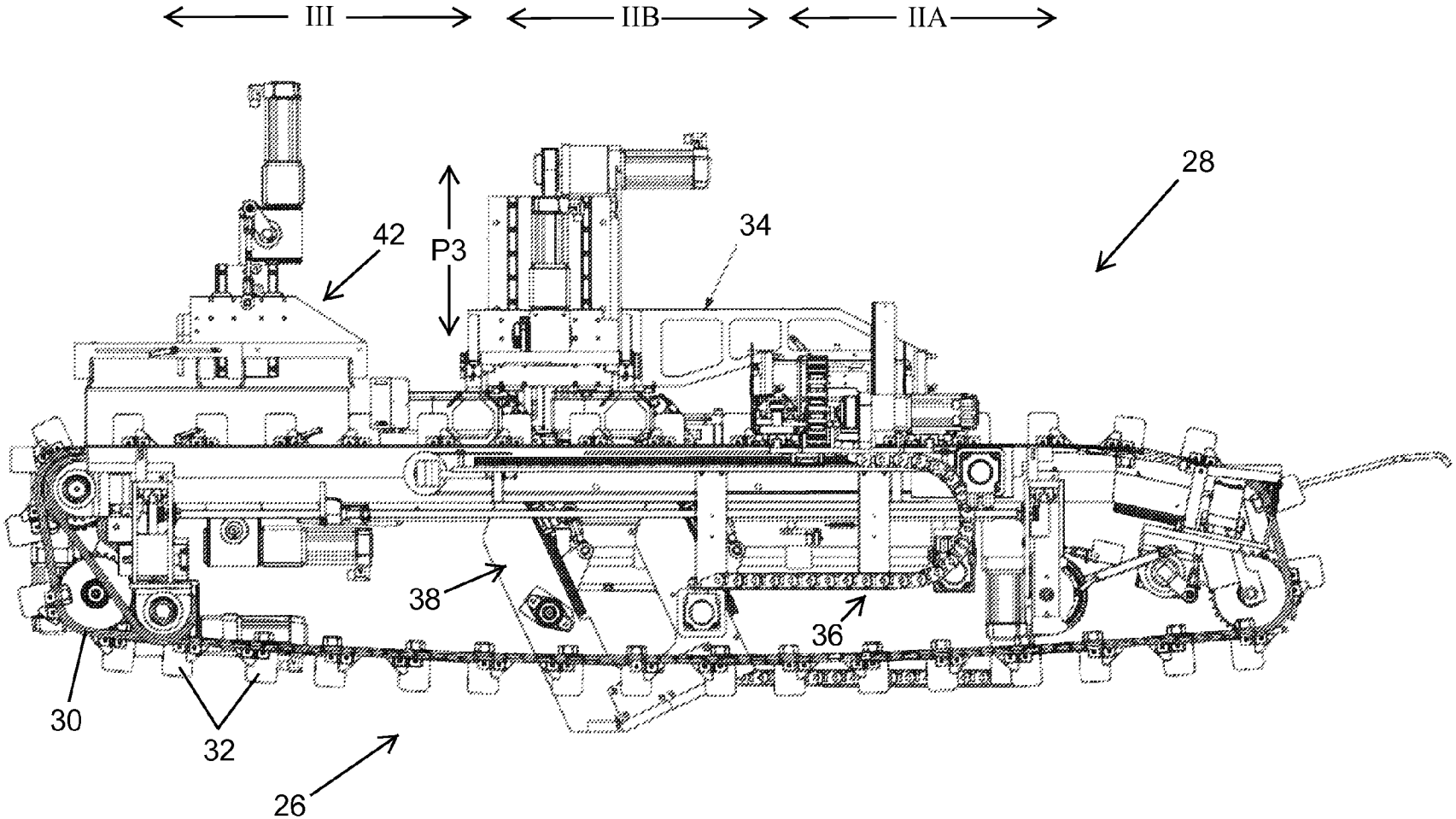
FIG. 5 depicts, in side elevation, the former stations or portions of FIG. 3.
Figure 8:
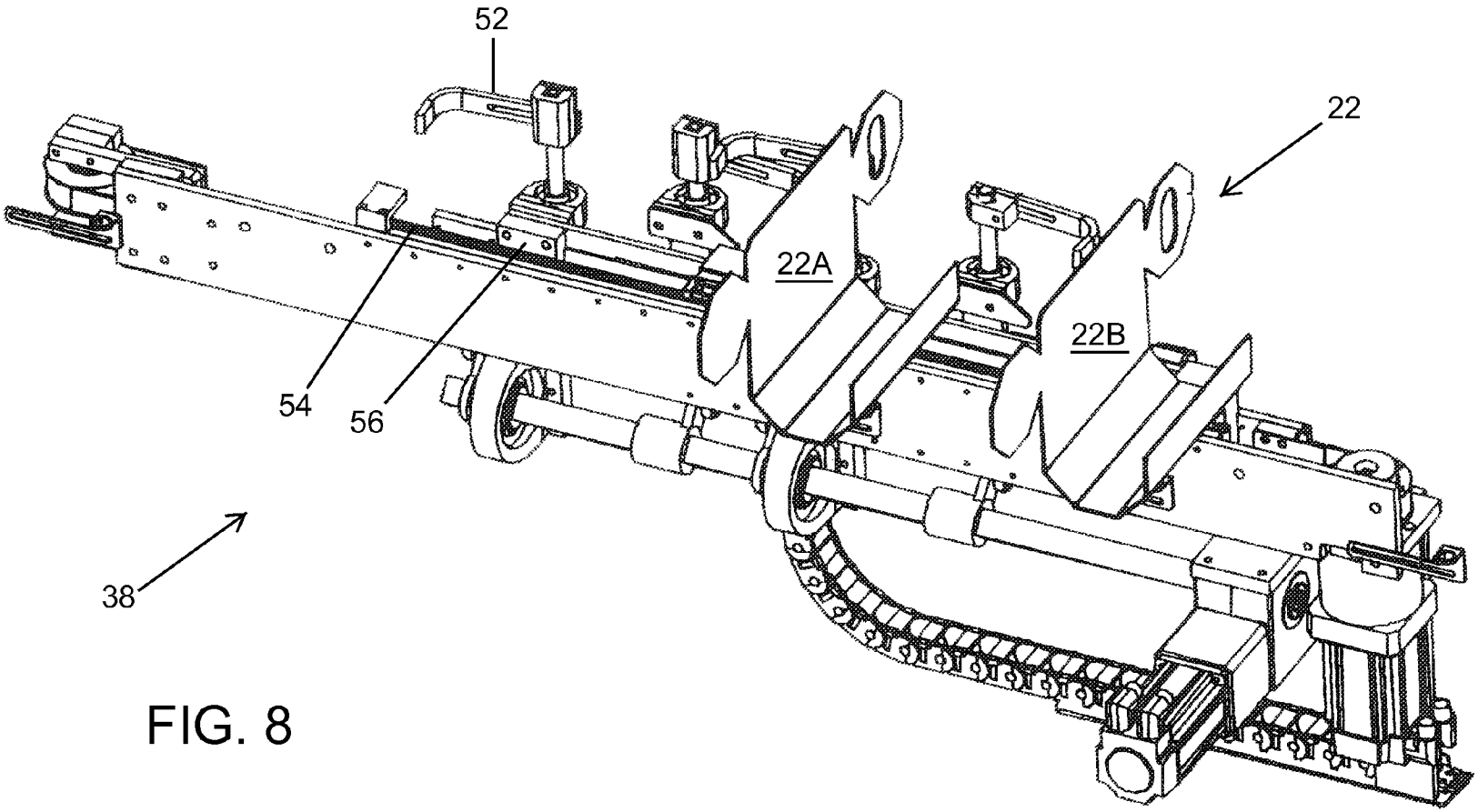
FIG. 8 depicts select elements of the initial case forming station II of the forming system of FIG. 1, more particularly, a presentation of "U" shaped case precursors for initial case forming operations in relation to a flap (minor) tucker or tucking assembly thereof.
Figure 9:
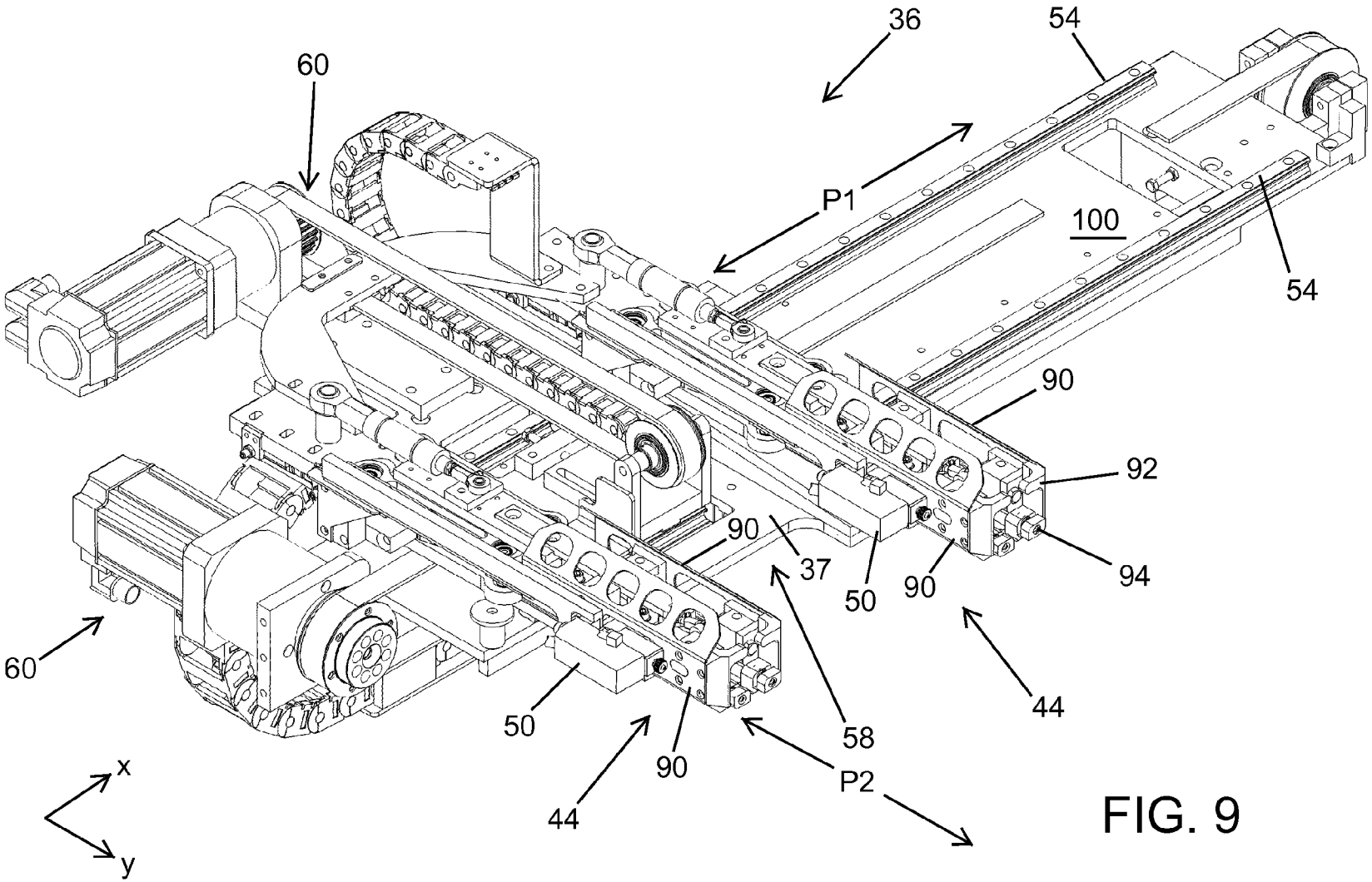
FIG. 9 depicts a traveling mandrel assembly of initial case forming station II of the forming system of FIG. 1 in a view as FIG. 7.
Figure 18:
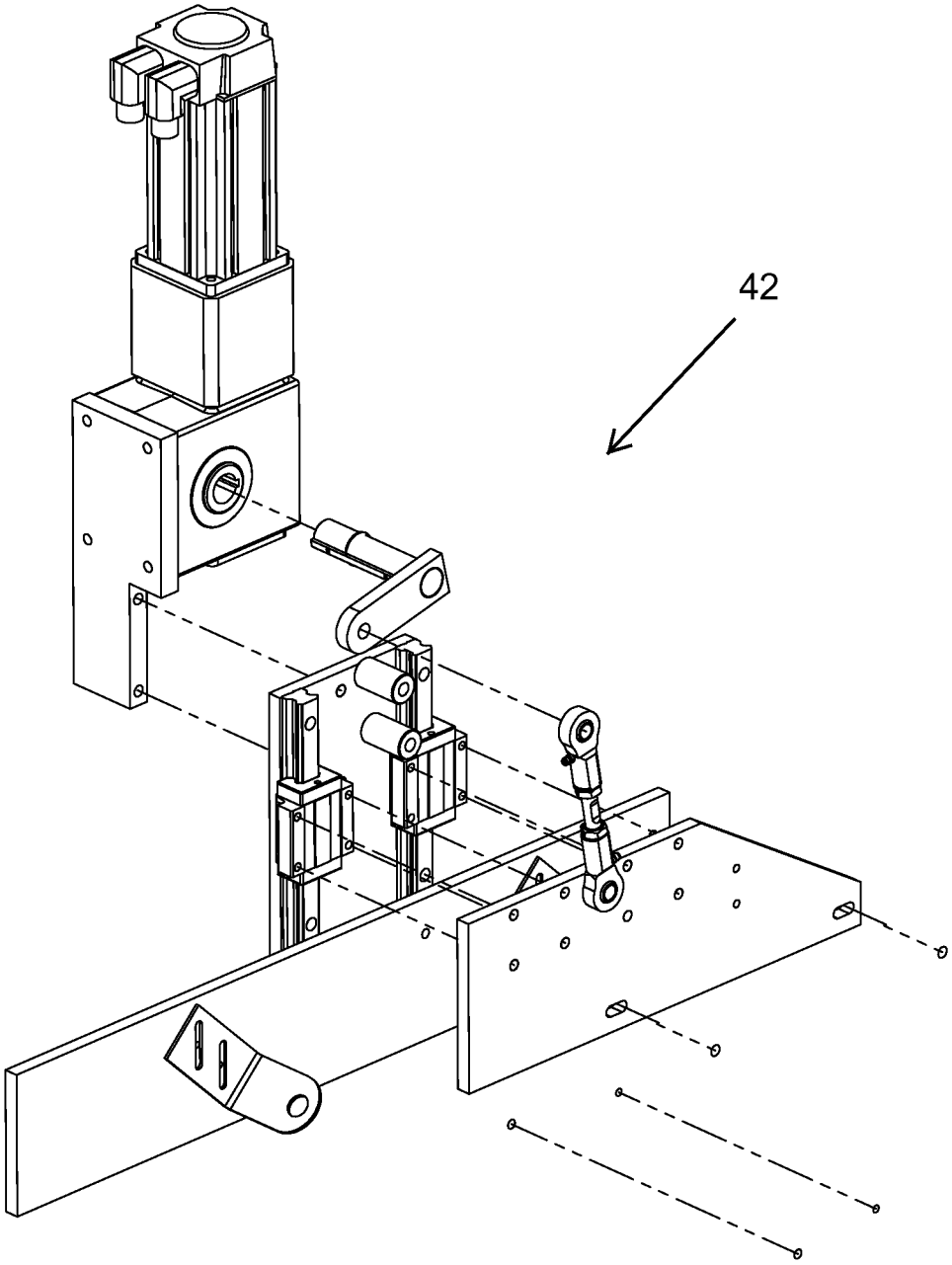

The balance of the figures, namely, FIGS. 8-18, are directed to select, assemblies, subassemblies or elements of or related to the former of FIG. 3, namely: a former ingress segment depicting spaced apart case precursors, i.e., those presented in an advantageous asymmetrical "U" shape configuration, and a movably mounted flap tucker assembly (FIG. 8); a traveling mandrel assembly (FIG. 9); the continuous motion case forming mandrel of FIG. 9 in two views (FIGS. 10 & 11), and alternate depictions, parts transparent/removed, showing details of an expansible frame mechanism (FIGS. 12 & 13); alternately equipped continuous motion case forming mandrels, namely, those characterized by substituted alternately configured expansible mandrel frames (FIGS. 14 & 15); a subassembly of an initial case forming station, i.e., an initial or primary multi-function case set-up apparatus (FIG. 16); a further subassembly of the initial case forming station (FIG. 17); and, a subassembly of the subsequent forming station (FIG. 18).

The subject disclosure generally commences with an overview of contemplated, advantageous, non-limiting case precursor processing in furtherance of case formation. Thereafter, select features of the former and/or select assemblies or subassemblies thereof will be discussed.

Figure 1:
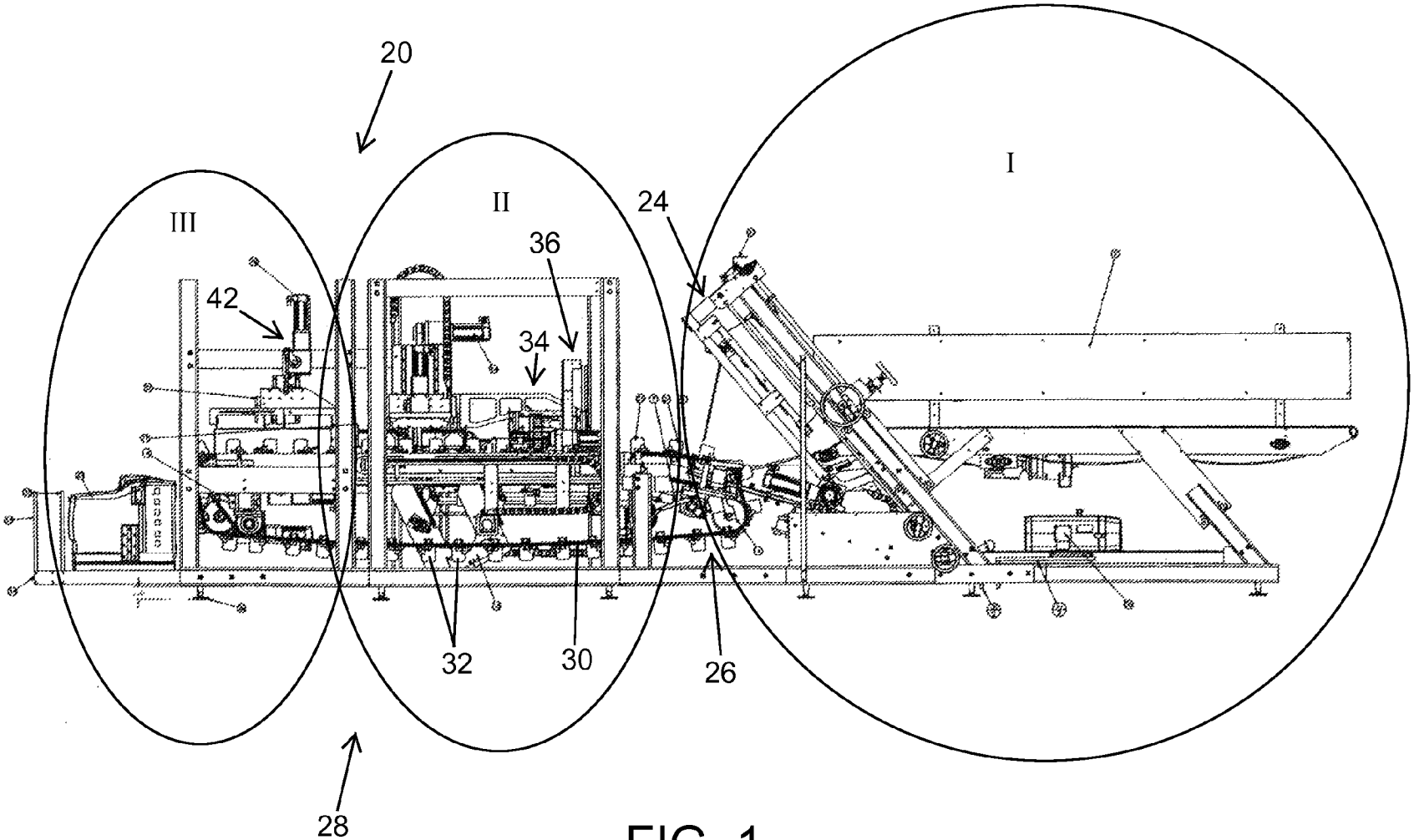
FIG. 1 depicts, in side elevation, an advantageous, non-limiting continuous motion case forming system, work flow from right to left, the system generally characterized by a case precursor feed station I, an initial case forming station II, and a subsequent case forming station III.
Figure 2:
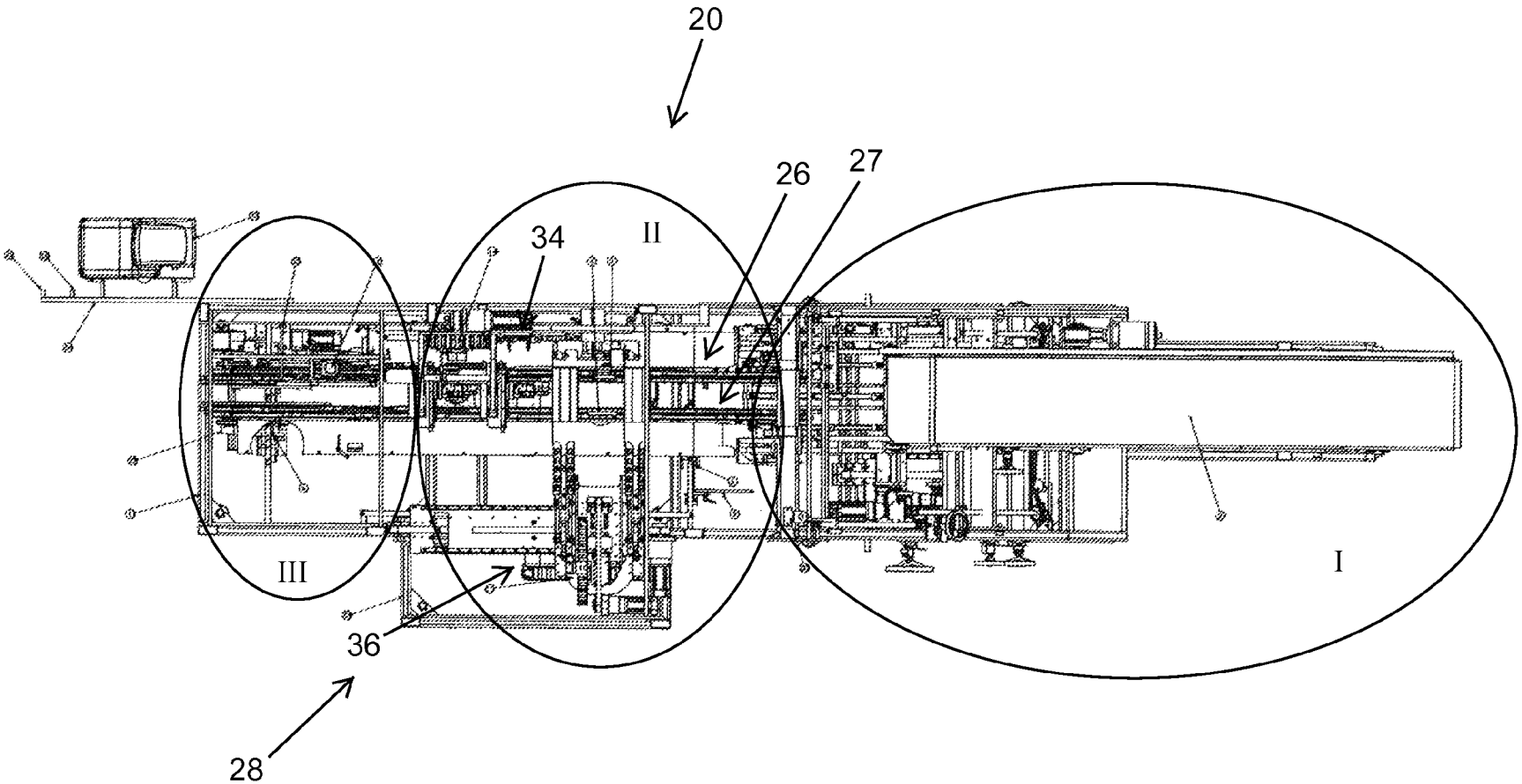
FIG. 2 depicts, overhead view, the system of FIG. 1.

As to processing, with initial and cursory reference to the continuous motion case forming system 20 of FIGS. 1 & 2, it is to be noted that work flow generally proceeds from page right to page left, with a generally linear processing path for the work pieces (i.e., case precursors, e.g., case blanks or sleeves). The system 20 may be generally and fairly characterized by a case precursor feed station I, an initial case forming station II, and a subsequent case forming station III.

By way of reference or overview, case precursors 22, advantageously but not necessarily those formatted or configured as blanks and opposed to sleeves or the like, are individually dispensed or metered from a power fed magazine 24 of feed station I. Vacuum arms, or functionally equivalent elements, transfer a case precursor to a conveyance device or apparatus 26 of a case former 28, namely, to a flight chain 30 as shown. More particularly, the case precursors 22 are received between spaced apart lugs 32 of the flight chain 30 and thereby assume a preliminarily manipulated state or condition, i.e., a condition characterized by creasing of a case precursor panel intended to delimit adjacent case sidewalls, e.g., an asymmetrical "U" shaped configuration as best seen with reference to FIG. 8. While formation of an octagonal case, especially well suited for housing bagged goods, e.g., bagged liquids such as wine, is contemplated/represented in the depictions of FIGS. 1-8, with suitable forming structures provided as best appreciated with reference to FIGS. 9-12, both a multi-function case set-up apparatus 34 and a traveling mandrel assembly 36 of initial forming station II are contemplated for ready adaptation in furtherance of forming cases of alternate configurations, for example, and without limitation, cases possessing or characterized by polygonal cross sections.

Advantageously, but not necessarily, case precursors 22 are metered upon/onto the conveyance apparatus 26, or in respect to the work stations of the case former 28, in pairs, i.e., two spaced apart case precursors are presented for work to be simultaneously conducted in work stations of the former as will be readily appreciated as the subject description proceeds. It is to be understood that the forming system/former may be modified such that the work stations thereof operate on a single metered case precursor, or simultaneously operate upon a select number of case precursors exceeding the two case precursors contemplated and as may be depicted.

Operations of initial case forming station II generally comprise, at or about first IIA and second IIB spaced apart positions (see e.g., FIG. 5), adhesive application within or at position IIA of initial case forming station II. Thereafter, upon a transition from position IIA to IIB, case precursor manipulations are performed, namely, "minor" flap tucking via a movably mounted flap tucker assembly 38 (note e.g., FIG. 7 and particulars thereof, FIG. 8). Further operations of first "major" flap (i.e., "inner major") tucking is advantageously executed by a further flap tucker or tucking the assembly 40 of FIG. 17 positioned as indicated in at least FIG. 5, case sidewall forming (e.g., folding or bending between sidewall forming elements as will be later detailed in connection to cooperated operation of the case set-up apparatus (e.g., FIG. 16) and the mandrel assembly (e.g., FIG. 9)) and further select adhesive application to portions of the manipulated case precursor are performed at second spaced apart position IIB of the initial case forming station. It is to be preliminarily noted that the mandrel assembly, moveably mounted adjacent the case set-up apparatus for travel with respect thereto, is provided to greatly facilitate case set-up at case forming station II, more particularly, with or at position IIB of initial case forming station II via the case set-up apparatus (note e.g., FIGS. 7 & 16).

Figure 7:
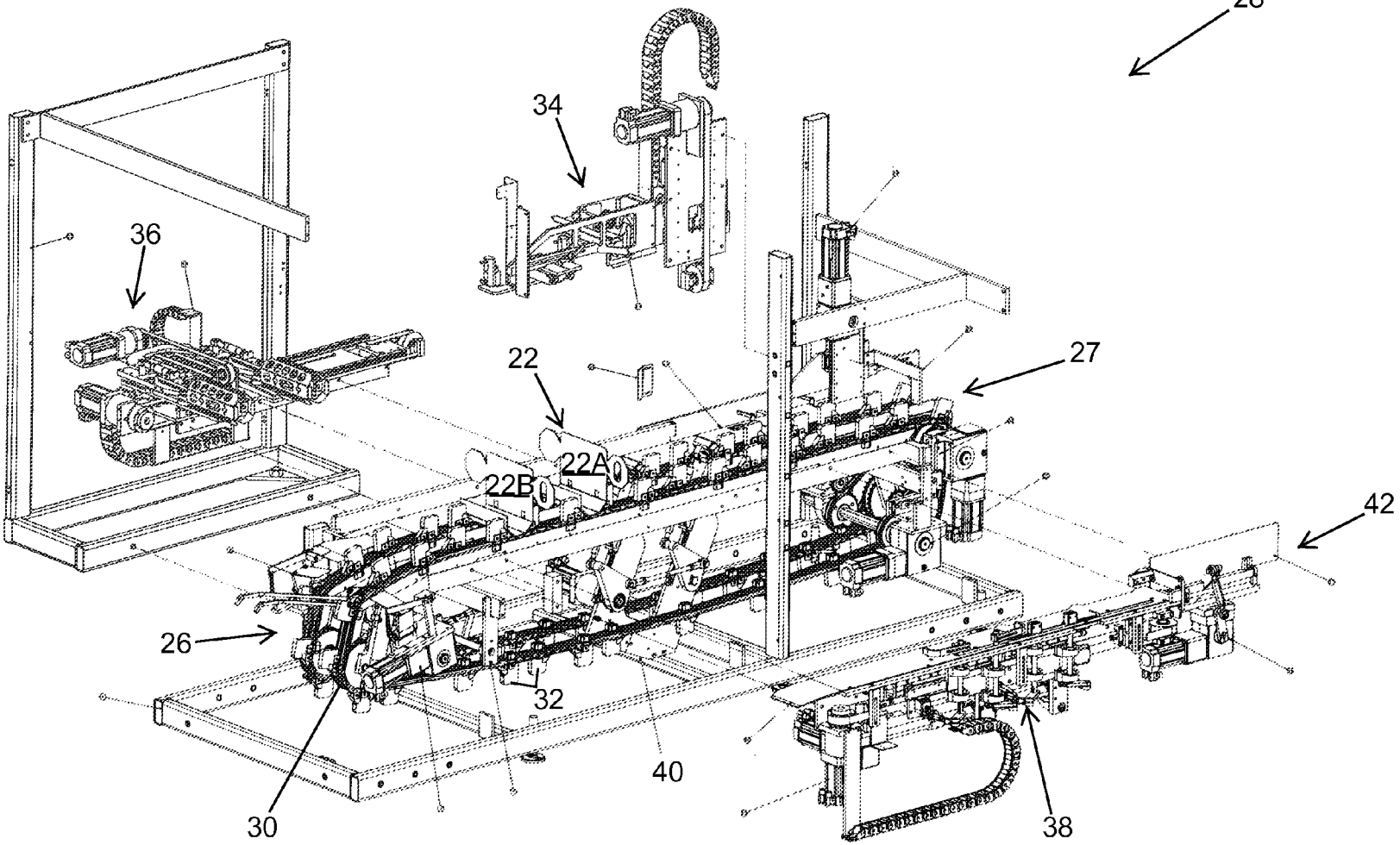
FIG. 7 depicts select stations, portions or assemblies of the former of FIG. 3, partially exploded and view from "behind"

Operations of subsequent case forming station III generally comprise adhesive application to the initially formed cases, and final tucking/"squaring"/compression so as to delimit a "finished" case end via a further case set-up apparatus, namely, a case square assembly 42 (note e.g., FIG. 7, and particulars thereof, FIG. 18). More particularly, adhesive is selectively applied to an exterior portion of the inner major flap, and subsequently a second "major" (i.e., "outer major") flap is tucked, the case end squared and compressed in furtherance of establishing a fully formed case end, namely, a case base. Thereafter, the formed cases are transferred from the system, more particularly, the former, to or onto a take-away conveyance apparatus or device (not shown) wherein powered belts or the like rotate the formed case from the former so as to upwardly position an "open" case end, i.e., vertically position the formed case such that the yet-to-be-closed case top is "up" and the fully formed case base is "down," in furtherance of subsequent filling operations or the like.

Noteworthy features attendant to the instant process or operation include, among others, continuous or intermittent motion assemblies which eliminate start/stop operations associated with heretofore known assemblies, e.g., the movably mounted mandrel and, as circumstances warrant (e.g., upon the case cross section, more particularly, a width associated therewith), an optional movably mounted flap tucker or tucking assembly. More particularly, and as will be later described in further detail, the mandrel assembly is movably mounted adjacent the case set-up apparatus for travel (e.g., translation) with respect thereto, with a case forming mandrel thereof movably mounted for continuous motion delimited by travel between an upstream locus and a downstream locus of the conveyance path, and reversible extension towards case precursors during travel between the upstream and downstream loci. Similarly, a flap tucker or tucking assembly, for manipulation of minor flaps subsequent to adhesive application at the first position (IIA) of the initial case forming station II, and in advance of further case precursor manipulations at the second position (IIB) of the initial case forming station II, may optionally be movably mounted in relation to the case set-up apparatus for continuous, selective or intermittent translation, more particularly, translation generally between the upstream and downstream loci of the traveling mandrel assembly.

Figure 6:
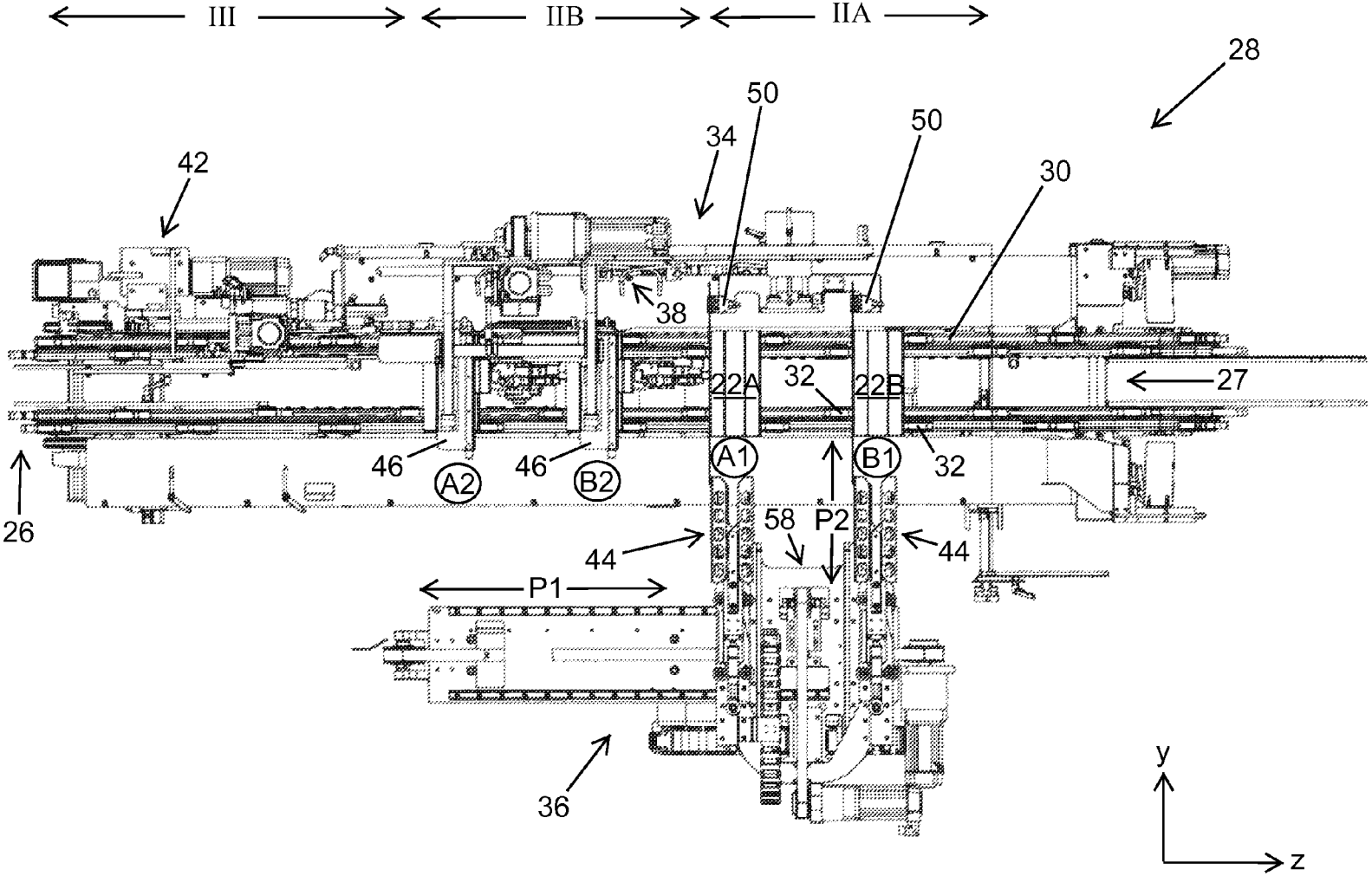
FIG. 6 depicts, overhead view, the former stations or portions of FIG. 3.

Finally with regard to operations, and in furtherance of supporting subsequent discussions of select former features, comments in connection to the processing "snap-shot" of FIG. 6 are warranted. While general reference to FIGS. 3-5 may prove helpful, select specific reference to one or more of the alternate views thereof will be noted for the sake of clarity or particulars.

In keeping with the discussion to this point, a pair of spaced apart case precursors 22A, 22B, positioned at loci A1 & B1 as indicated (i.e., an upstream pair), are retained within flight chain lugs 32 of the conveyance apparatus 26 for indexed travel to loci A2, B2 respectively as indicated along a conveyance path 27. It is to be appreciated that in addition to upstream pair at position 1, there is simultaneously situated a downstream pair of spaced apart case precursors at position 2. Noteworthy relationships for, between, and among assemblies of the former of FIG. 6, as may be indicated, are hereinafter noted.

First, the flap tucker assembly 38 may be movably mounted adjacent the conveyance apparatus 26 for reversible x-direction travel (FIG. 3), e.g., x-direction translation, within a range generally delimited by locus A2 and locus B1. Advantageously, the flap tucker assembly 38 may be movably mounted adjacent the conveyance apparatus 26 for reversible x-direction travel within a range generally delimited by locus A2 and locus A1.

Second, the mandrel assembly 36 is movably mounted adjacent the conveyance apparatus 26 (FIG. 6) for reversible x-direction travel (FIG. 3), e.g., x-direction translation, within a range generally delimited by locus A2 and locus B1, and advantageously, within a range generally delimited by locus A2 and locus A1, so as to delimit travel path Pl. The case forming mandrels 44 thereof are in turn each movably mounted for reversible y-direction travel (FIG. 3), e.g., y-direction translation so as to delimit travel path P2, in furtherance of positioning same in operative relation to and with the manipulated case precursors and the case set-up apparatus 34 at loci A2, B2. More particularly, the continuous case forming mandrel 44 is movably mounted for extension (e.g., "y" direction translation (FIG. 3)) towards the manipulated case precursors traveling from loci A1, B1 to loci A2, B2 respectively (i.e., the continuous motion case forming mandrel is advantageously characterized by simultaneous x-y downstream travel along paths Pl, P2, with an upstream return travel path generally comprised of a y-direction retraction, i.e., work piece withdrawal, (P2) followed by an x-direction upstream reverse (P1)). It is to be noted that the rate of approach for the continuous motion case forming mandrel in relation to the work pieces may or may not be constant.

Figure 16:
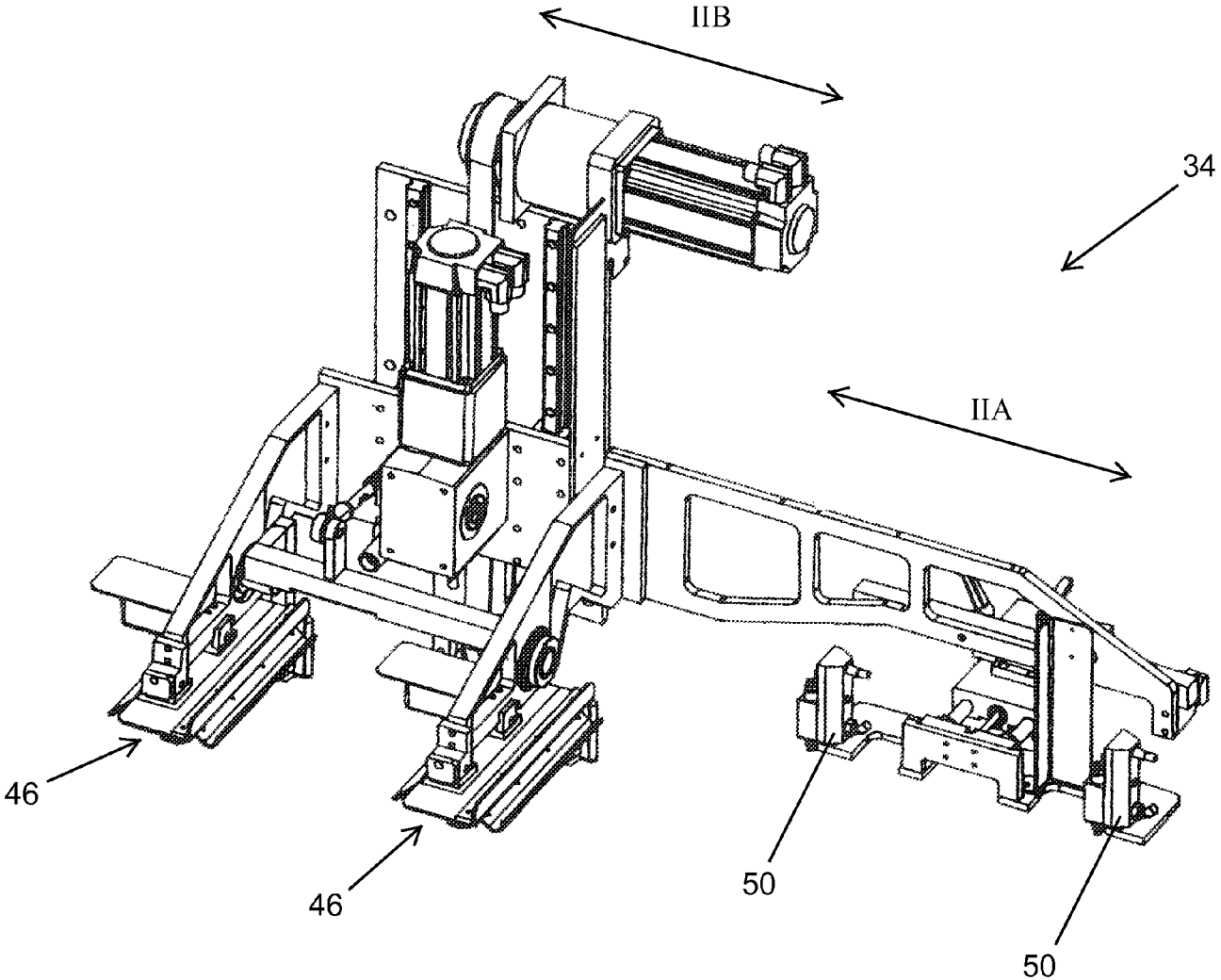
FIG. 16 depicts a subassembly of initial case forming station II of FIG. 1, namely, a multi-function case set-up apparatus of the station.
Figure 17:
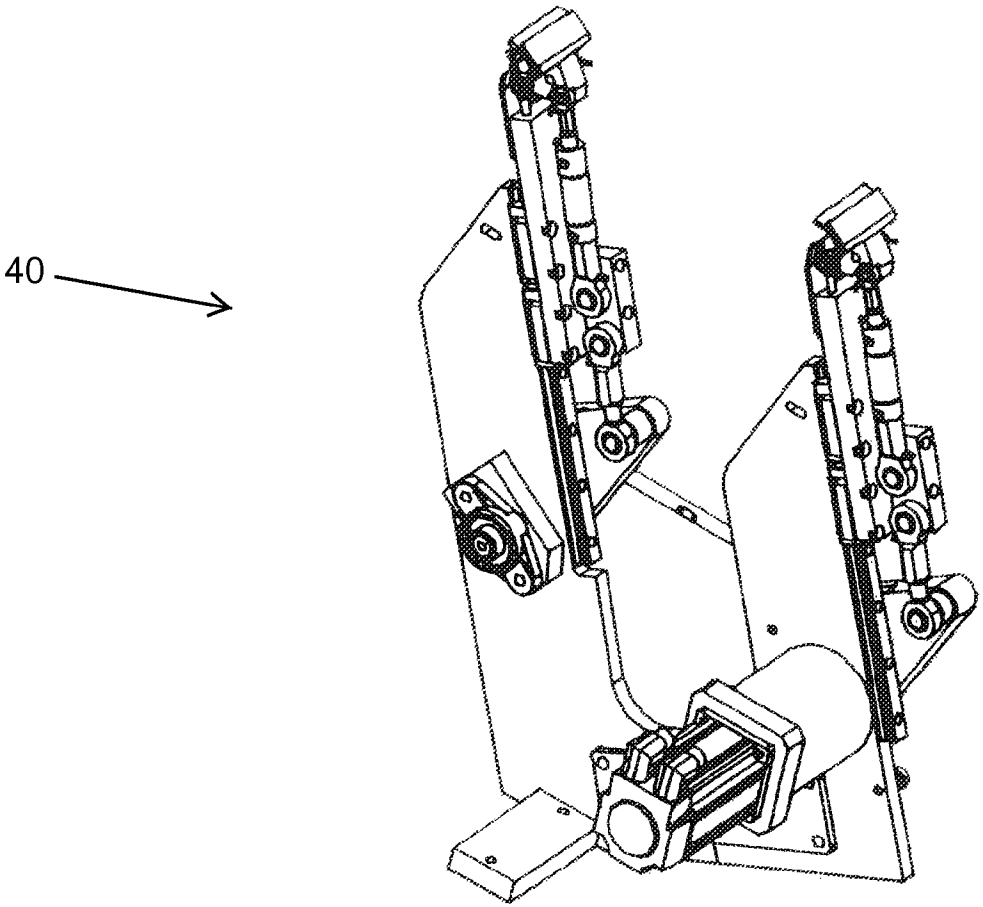
FIG. 17 depicts a further subassembly of initial case forming station II of FIG. 1, namely, a further flap (major) tucker or tucking assembly; and, FIG. 18 depicts a subassembly of subsequent case forming station III of FIG. 1, namely, a case square assembly.

Third, the case set-up apparatus 34, characterized by spaced apart case forming members, e.g., frames 46, is movably mounted adjacent the conveyance apparatus 26, more particularly, over conveyance path 27 of the case precursors, for reversible z-direction travel, e.g., z-direction translation (i.e., an up/down indexed travel in the view of FIG. 5 so as to delimit travel path P3), in furtherance of operative engagement of case precursors by at least a portion of the apparatus at loci A2, B2, and advantageously by portions of the apparatus at both loci A1, B1 and loci A2, B2 (i.e., advantageously but not necessarily, the apparatus is equipped with adhesive dispensers, e.g., a glue gun 50 or the like as shown in FIG. 16, which, owing to a spaced apart condition in relation to the case forming members 46, operates upon case precursors at position 1).

Functionally, case precursors positioned at loci A1 & B1 (i.e., position 1) receive an application of adhesive from adhesive dispensers 50 of a portion of the case set-up apparatus 34, the case set-up apparatus being indexingly actuatable, more particularly, vertically translatable towards and away from the indexing work pieces (i.e., case precursors) to complete this task at this local while simultaneously participating in a case sidewall forming task at position 2. During downstream indexing of the case precursors, i.e., from A1 to A2 and B1 to B2, the movably mounted flap tucking assembly 38 travels an out and back (i.e., upstream/downstream) path with the flap tuckers, e.g., arms 52, of the traveling flap tucker assembly 38 engaging and operating upon the minor flaps of the case precursors in advance of operations relating to major flap tucking as by assembly 40 of FIG. 17 and sidewall formation via cooperative engagement of the continuous motion mandrel 44 and the downstream portions of case set-up apparatus 34. Alternately, such flap tucking operation may selectively be conducted without a loss of operational efficiency at the downstream loci (i.e., A2, B2) via a fixedly positioned flap tucker assembly.

During the period of position 1 to position 2 transition, mandrel assembly 36 travels from position 1 to position 2 with the continuous case forming mandrel thereof traveling towards conveyance path 27 all-the-while such that the case forming mandrels 44 are operatively situated at position 2 to "enter" the case precursors likewise arriving there in addition to the case forming members 46 of the case set-up apparatus 34 descending thereupon so as to essentially urge a portion of the case precursor about the expanded expansible elements of the case forming mandrels. As previously noted, further position 2 operations include additional adhesive application(s), advantageously but not necessarily performed by the case forming mandrel adapted for such function in furtherance of securing case precursor free end longitudinal panel portions.

As to features of the former and/or select assemblies or subassemblies thereof, attention next is generally directed to select advantageous assemblies of the former, for example and without limitation, the assemblies depicted in FIG. 7 in an operatively disassociated state or condition relative to the conveyance apparatus or as otherwise designated or referenced. More particularly, the subject discussion next proceeds with regard to the traveling flap tucker assembly 38, detail FIG. 8 and the mandrel assembly 36, detail FIG. 9, and subassemblies thereof depicted in FIGS. 10 & 13, including the FIG. 10 structural alternatives depicted in each of FIGS. 14 & 15.

With particular reference to FIG. 8 and general reference to FIGS. 6 & 7, there is depicted traveling flap tucker 38, more particularly, a flap tucker or tucking assembly movably mounted in relation to the conveyance apparatus 26/case set-up apparatus 34. Advantageously, but not necessarily, two spaced apart pairs of actuatable tuckers, e.g., arms 52 as shown, are generally supported for travel along a travel path delimited by a support member, e.g., as by cooperative engagement for and between a track or rail segment, i.e., a travel guide 54, and one or more carriages 56 receivable thereupon. Known drive assemblies, e.g., those characterized by servos and conventional linkage elements, selectively and precisely drive the supported arms 52 in relation to the guide 54.

With particular reference to FIG. 9, traveling mandrel assembly 36 is characterized by known mechanisms to effectuate the previously noted linear motions, namely, each of x-y direction translations along paths P1, P2. Essentially, a mandrel assembly head 58, characterized by spaced apart case forming mandrels 44 advantageously equipped with adhesive dispenser adhesive dispensers 50, is generally supported for travel, more particularly y-direction travel as indicated in keeping with the established convention of the description, along travel path P2 delimited by one or more support members, e.g., as by cooperative engagement for and between a track or rail segments, (i.e., a travel guide 54, not visible but nonetheless appreciated with reference to FIG. 12, supported upon mandrel assembly base 37), and carriages 56 (e.g., FIGS. 10 & 12) receivable thereupon. Known drive assemblies, e.g., those characterized by servos and conventional linkage elements, selectively and precisely drive the mandrel assembly head 58, in relation to the base 37, upon guide 54. The mandrel head assembly 36, and its attendant drive assembly 60, is in turn operatively supported for travel in relation to mandrel head assembly support 100 in like manner as the mandrel head assembly per se, more particularly, x-direction travel along travel path P1 delimited by one or more travels guides 54 supported thereon in keeping with the established convention of the description.

Figure 12:
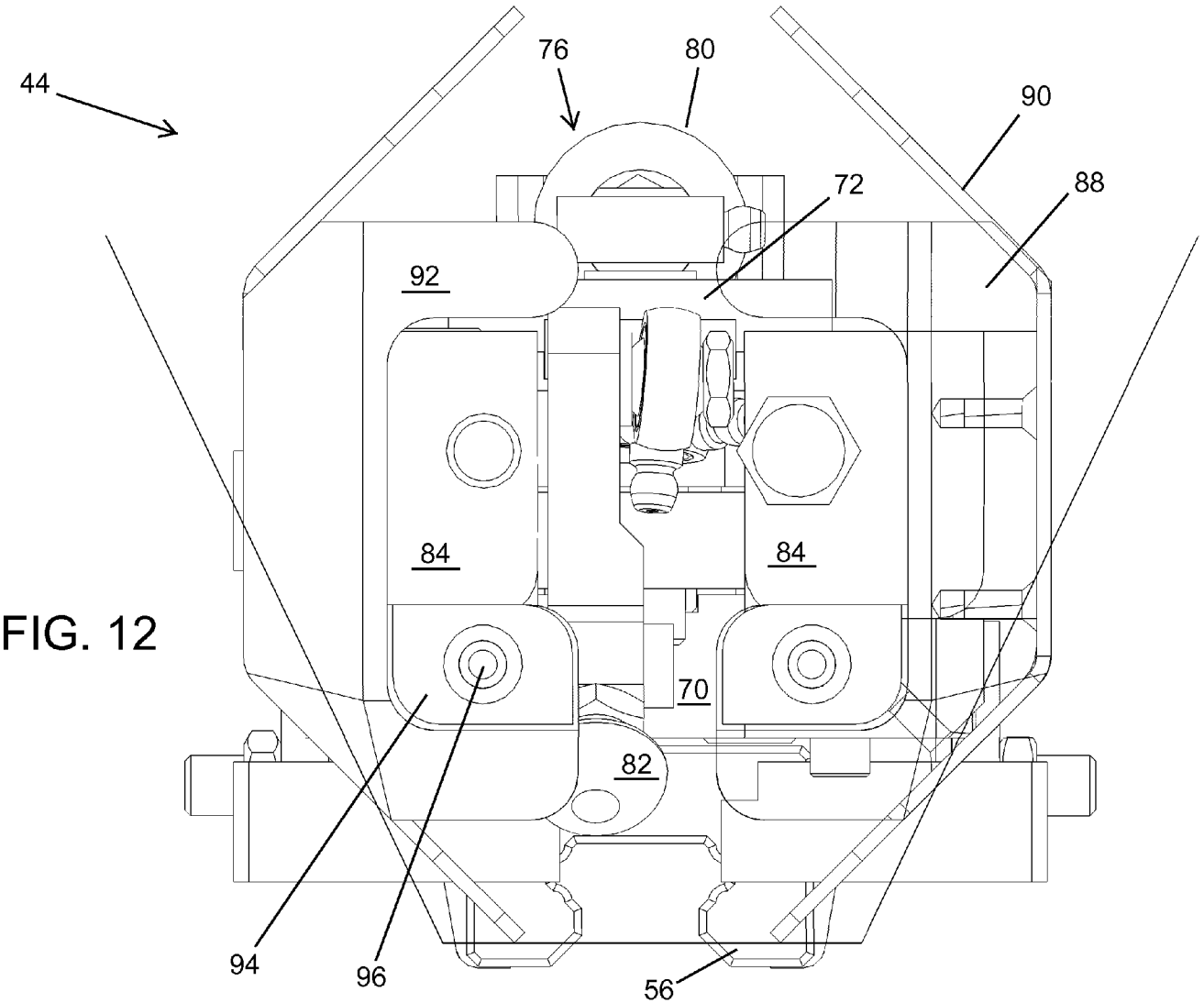
FIG. 12 depicts, end elevation select parts removed to reveal particulars, a free end of the continuous motion case forming mandrel of FIG. 10.
Figure 13:
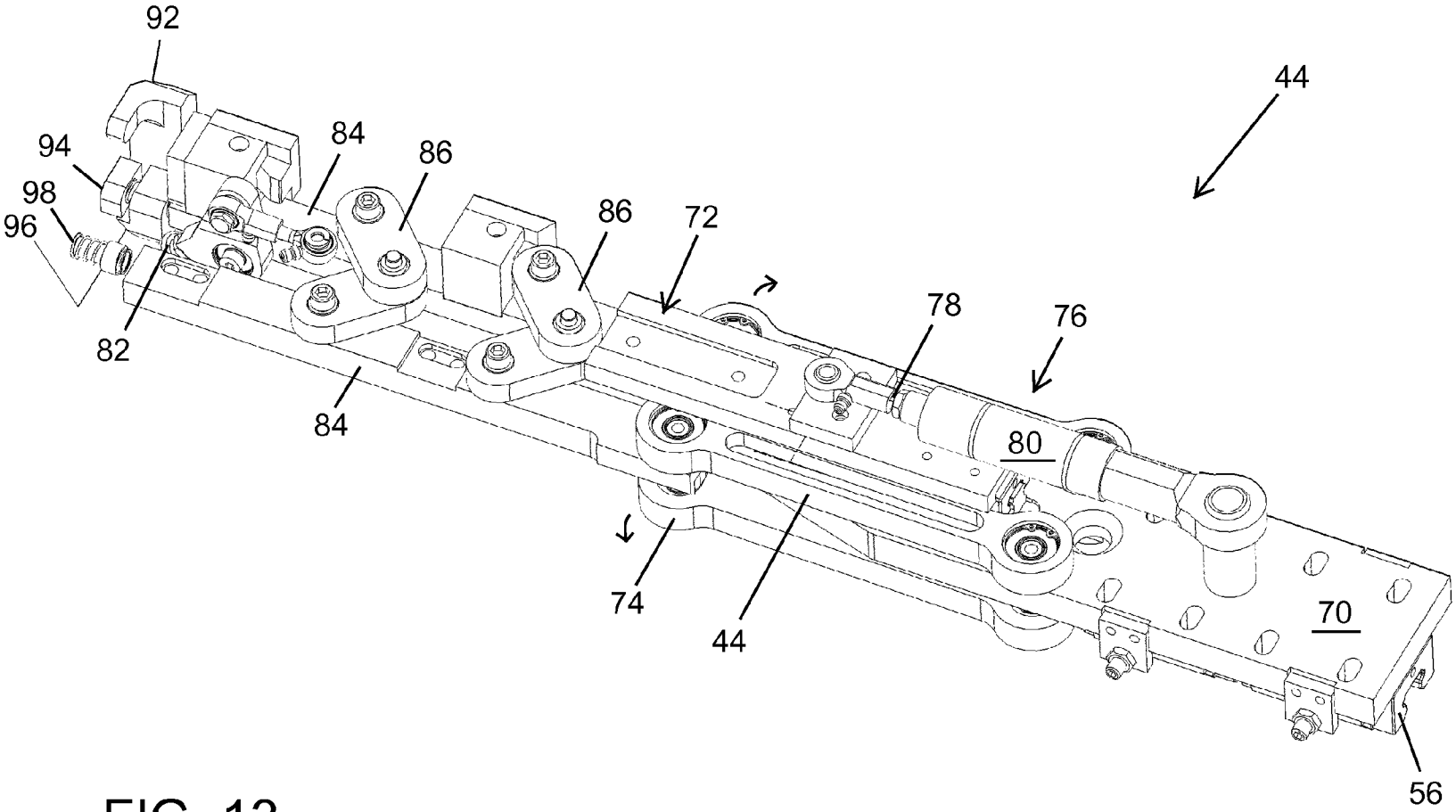
FIG. 13 depicts, in perspective, slightly from above select parts removed to reveal particulars, an opposing side view of the continuous motion case forming mandrel of FIG. 10.
Figure 14:
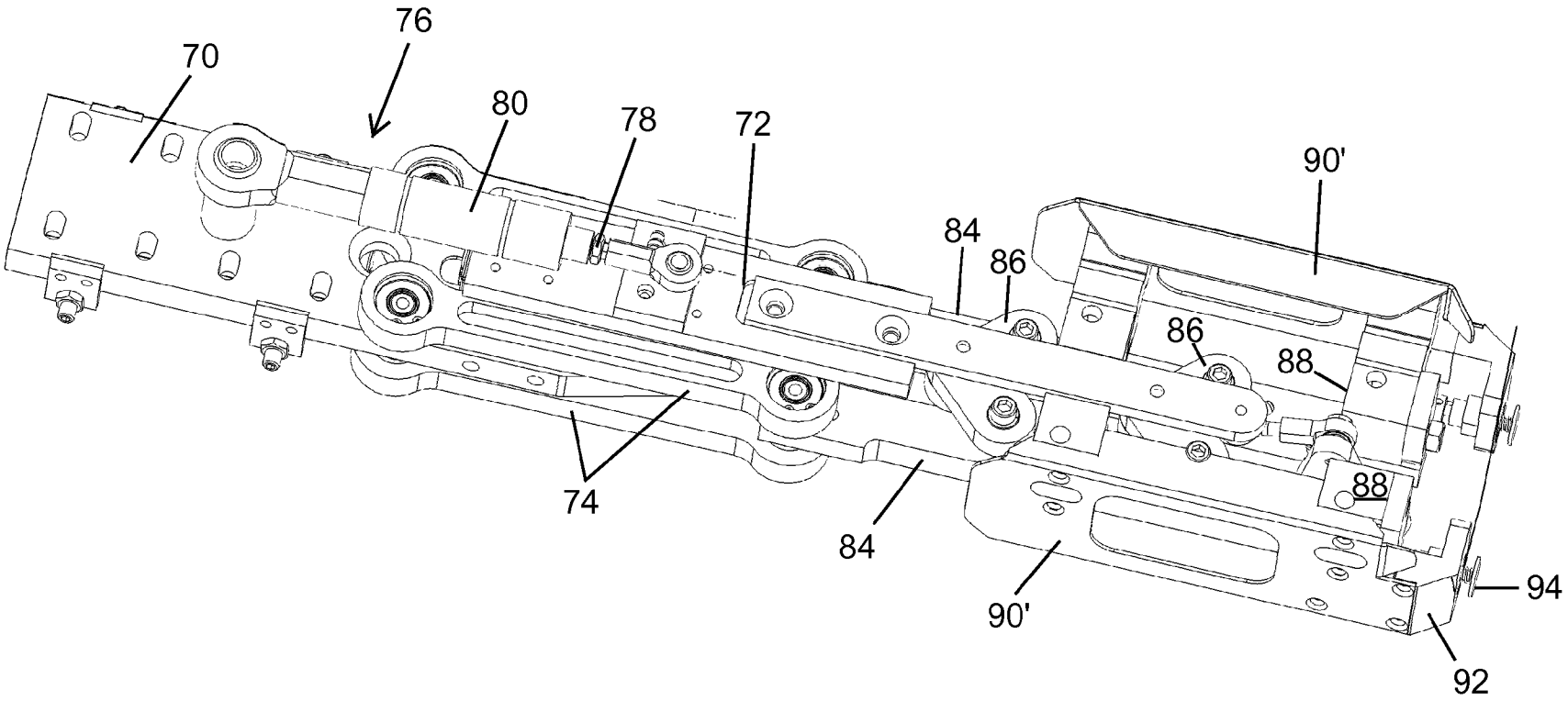
FIG. 14 depicts, in perspective, slightly from above, an alternate continuous motion case forming mandrel of/for the traveling mandrel assembly of FIG. 9, more particularly, a continuous motion case forming mandrel equipped with alternate expansible mandrel frames.
Figure 15:
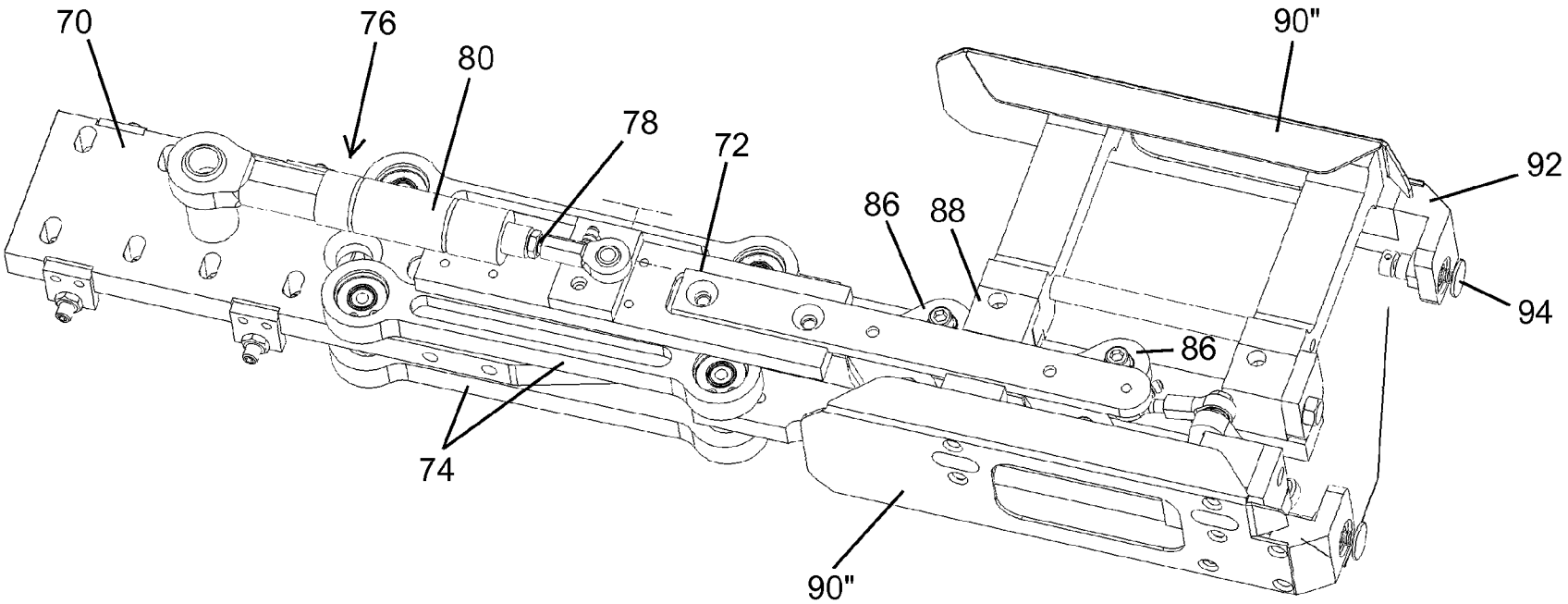
FIG. 15 depicts, in perspective, slightly from above, a further continuous motion case forming actuatable mandrel of/for the traveling mandrel assembly of FIG. 9, more particularly, a continuous motion case forming mandrel equipped with further alternate expansible mandrel frames.

With particular reference now to FIGS. 10-13, there is generally depicted an advantageous, non-limiting continuous motion case forming mandrel of the traveling mandrel assembly of FIG. 9, with alternate mandrels depicted in FIGS. 14 & 15 to support the formation of "small" and "large" rectangular cases. Discussion follows with general reference to FIGS. 10-15.

Figure 10:
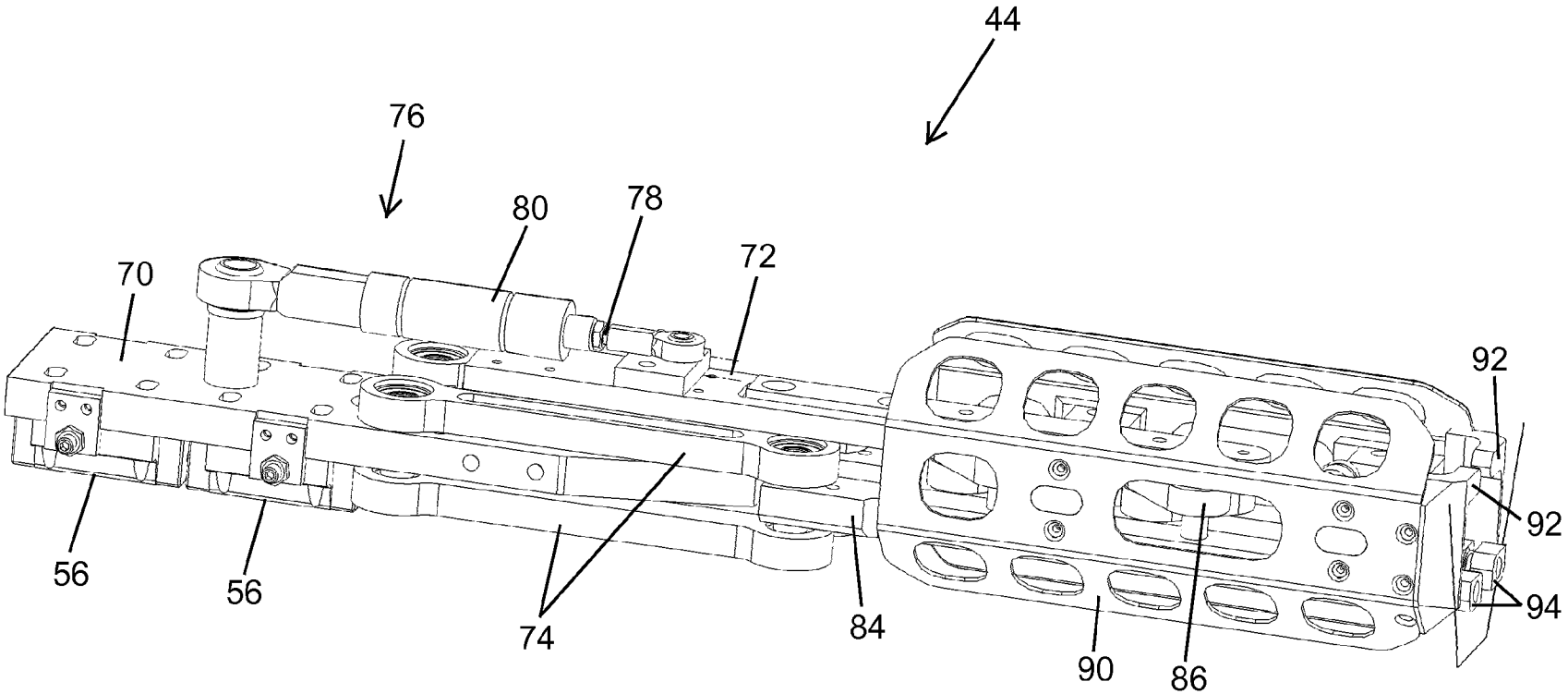
FIG. 10 depicts, in perspective, slightly from above, a continuous motion case forming mandrel of the traveling mandrel assembly of FIG. 9.

The continuous motion case forming mandrels 44 are generally characterized by a base 70 which supports coincident linkages, namely, a driven member 72 and a responsive linkage comprising two sets of paired links 74, e.g., a "left" and "right" (e.g., FIG. 11) pair comprising upper and lower links (e.g., FIG. 10). An actuatable drive assembly 76 characterized by a driver, e.g., a rod 78 extendible from a pneumatic cylinder 80, links the driven member 72 to the base 70, more particularly, operatively links the driven member 72 for reversible translation upon a track or rail segment 54 which slidingly unites the driven member 72 to the base 70 (FIG. 13). As best seen in connection to FIG. 11, note also FIGS. 12 & 13, a deployable support, in the form of a pivotable skid 82 as shown, is operatively united with a free end of the driven member 72 via suitable elements such that a free end of each of the case forming mandrels 44 is precisely and repeatingly positioned in relation to the case precursor which is to be generally formed thereabout, i.e., so as to maintain a select spaced apart condition for the free end of the mandrel relative to e.g., a longitudinal center line of/for the case.

The links 74 of the responsive linkage, more particularly, end portions of each, are operatively united to each other and the base 70 for pivot motion with respect thereto. Operatively supported between each set of paired upper and lower links are expansible arms 84, more particularly, the arms are hingedly supported between free end portions of each paired link 74 of the responsive linkage so as to in turn positioningly respond (i.e., reversible move away from each other) to motion imparted thereupon by the drive 78 of the actuatable drive assembly 76.

The arms 84 are operatively joined, intermediate their ends, via pivot links, e.g., spaced apart toggles 86 as shown (FIG. 13). The toggles 86, as indicated with reference to FIG. 11 and further appreciated in connection to the depiction of FIG. 13, are united with, joined to, or more generally responsive to translation the driven member 72 (FIG. 11) so as to effectuate a spaced apart condition, more particularly, a substantially parallel spaced apart condition for and between the arms 84 joined thereby as the paired links 74 outwardly pivot or rotation at their distal end (FIG. 11).

Figure 11:
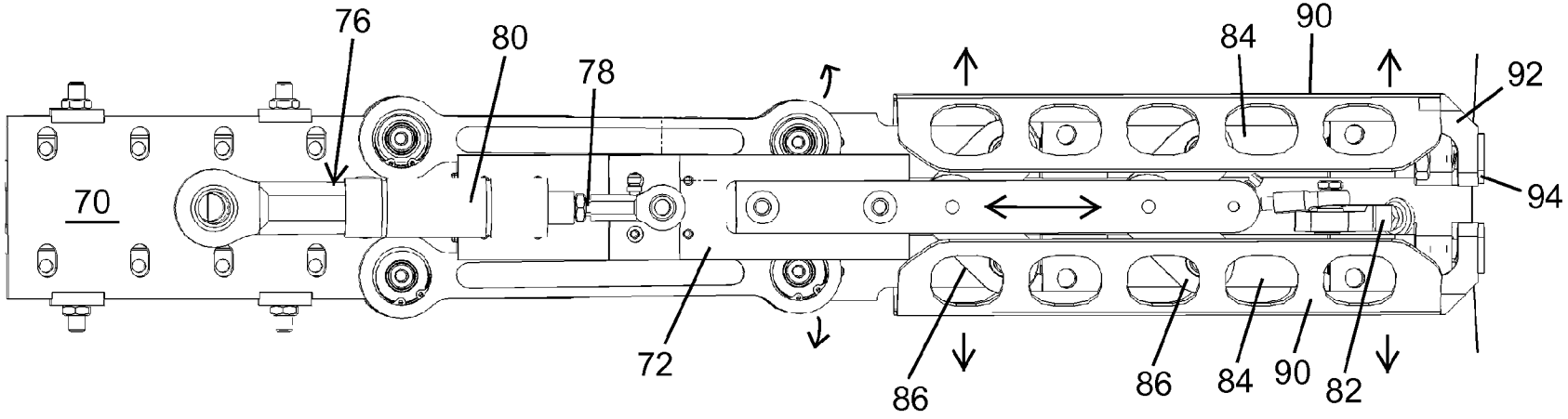
FIG. 11 depicts, overhead view, the continuous motion case forming mandrel of FIG. 10.

Each expansible arm 84 generally includes, e.g., supports, a suitable number of mounting structures or fixtures 88 (e.g., FIGS. 12 & 13) for receipt of elements, e.g., frames 90 as indicated (FIGS. 10-12, note also 90' (FIG. 14) and 90" (FIG. 15). The frames, which are essentially expansible frames owing to an expansible arm assembly predicated upon the above described and generally depicted elements, relationships and interrelationships, facilitate case forming via select positive engagement with a contour of the case precursor and case forming members of the case set-up apparatus during operations associated with position IIB of initial case forming station II, more particularly, sidewall formation via the case set-up apparatus. Moreover, the free ends of each of the arms 84 are adapted to include/support/carry, a case end contour former 92 and a bumper 94 assembly for cushioned engagement with a backplate associated with the case set-up apparatus. As shown in the depiction of FIG. 13, the bumper is resiliently supported upon a stud 96 or the like forward a free end of the arm via a spring 98 or like cushioning element.

While advantageous, non-limiting systems, apparatus, devices, mechanisms, assemblies, methods, etc. relating to automated case or carton manipulations, and/or operations upon a case or carton precursor in furtherance of case formation, namely, to continuous motion automated case set-up and intermittent motion case folding/case erection, are depicted, described and/or readily ascertained with reference to the instant disclosure, alternate not insubstantial functional equivalents are likewise contemplated to effectuate sought after process performance improvements and/or enhancements. Presently known and future developed means for effectuating the noted functionalities are understood to be within the scope of the instant disclosure.

Thus, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

That which is claimed:

1. A case forming apparatus comprising a mandrel head assembly and a mandrel head assembly support, said mandrel head assembly movably supported for reversible linear motion in relation to said mandrel head assembly support so as to define a mandrel head assembly travel path, said mandrel head assembly characterized by spaced apart case forming mandrels and a base upon which each spaced apart case forming mandrel of said spaced apart case forming mandrels is movably supported for reversible linear motion so as to define a case forming mandrel travel path, travel of said case forming mandrels through said case forming mandrel travel path being concurrent with travel of said mandrel head assembly through said mandrel head assembly travel path so as to thereby delimit a portion of a continuous motion travel path for said spaced apart case forming mandrels.

2. The apparatus of claim 1 wherein said case forming mandrels include opposing case forming elements for select tensioned engagement with portions of a case precursor corresponding to a sidewall thereof.

3. The apparatus of claim 1 wherein said case forming mandrels include an end portion characterized by expansible case sidewall forming elements.

4. The apparatus of claim 1 wherein said case forming mandrels include an end portion characterized by expansible case forming elements about which a case sidewall of a case precursor is formable.

5. The apparatus of claim 1 wherein said case forming mandrels include an end portion characterized by a case end wall forming element.

6. The apparatus of claim 1 wherein said case forming mandrels include a free end characterized by a resiliently responsive element.

7. The apparatus of claim 1 wherein said case forming mandrels comprise expansible arms, and frames supported by said expansible arms.

8. The apparatus of claim 1 wherein said case forming mandrels comprise a pair of arms, and toggles uniting arms of said pair of arms in furtherance of selectively establishing a spaced apart condition for said arms of said pair of arms.

9. Apparatus to aid continuous case formation from case precursors during conveyance of case precursors along a conveyance path of a conveyance system, the apparatus comprising a mandrel assembly, characterized by a base and a mandrel, and a fixedly positionable assembly support, said mandrel assembly operatively supported by said assembly support for translation thereupon via said assembly base so as to delimit an assembly travel path, said mandrel operatively supported by said base of said mandrel assembly for translation thereupon so as to delimit a mandrel travel path, said assembly travel path corresponding to a segment of the conveyance path of the conveyance system, said mandrel travel path comprising reversible extension of said mandrel towards a case precursor during translation of said mandrel assembly in relation to said assembly support.

10. The apparatus of claim 9 wherein said mandrel includes an end portion characterized by expansible case forming elements operably engageable with the case precursor.

11. The apparatus of claim 9 wherein said case forming mandrel comprises expansible arms and frames supported by said expansible arms.

12. The apparatus of claim 9 wherein said case forming mandrel comprises a pair of arms and toggles uniting arms of said pair of arms in furtherance of selectively establishing a spaced apart condition for said arms of said pair of arms.

13. The apparatus of claim 9 further comprising a drive assembly for effectuating translation of said mandrel assembly upon said fixedly positionable assembly support, said drive assembly operatively uniting said base of said assembly with said support.

14. The apparatus of claim 9 further comprising a drive assembly for effectuating translation of said mandrel upon said base of said mandrel assembly, said drive assembly operatively uniting said mandrel with said base.

15. The apparatus of claim 9 further comprising a further, second mandrel spaced in parallel arrangement relative to said mandrel, a first mandrel, said second mandrel operatively supported by said base of said mandrel assembly for translation thereupon, said second mandrel operable upon a case precursor adjacent a case precursor operated upon by said first mandrel.

16. The apparatus of claim 9 wherein translation of said assembly relative to said support is characterized by an advancement rate and a retraction rate, said retraction rate exceeding said advancement rate.

17. The apparatus of claim 9 wherein translation of said mandrel relative to said base is characterized by an advancement rate and a retraction rate, said retraction rate exceeding said advancement rate.

18. The apparatus of claim 9 wherein translation of said mandrel relative to said base is characterized by an advancement rate and a retraction rate, said advancement rate exceeding said retraction rate.

19. The apparatus of claim 9 wherein translation of said mandrel relative to said base is characterized by an advancement rate and a retraction rate, said advancement rate and said retraction rate being substantially equivalent.

20. The apparatus of claim 9 wherein translation of said mandrel relative to said base is characterized by an advancement rate and a retraction rate, portions of said mandrel actuatable for engagement with a the case precursor subsequent to advancement and prior to retraction of said mandrel.

* * * * *